US009385464B2

(12) United States Patent
Wu et al.

(10) Patent No.: US 9,385,464 B2
(45) Date of Patent: Jul. 5, 2016

(54) CABLE CONNECTOR ASSEMBLY HAVING SEVERAL PLUG CONNECTORS

(71) Applicant: FOXCONN INTERCONNECT TECHNOLOGY LIMITED, Grand Cayman (KY)

(72) Inventors: Xiao-Gang Wu, Kunshan (CN); Duo Yang, Kunshan (CN); Cheng-Pang Chen, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/548,198

(22) Filed: Nov. 19, 2014

(65) Prior Publication Data

US 2015/0140843 A1 May 21, 2015

(30) Foreign Application Priority Data

Nov. 20, 2013 (CN) ..... 2013 2 0734945 U

(51) Int. Cl.
*H01R 13/447* (2006.01)
*H01R 27/02* (2006.01)
*H01R 27/00* (2006.01)

(52) U.S. Cl.
CPC ..... *H01R 13/447* (2013.01); *H01R 27/00* (2013.01); *H01R 27/02* (2013.01)

(58) Field of Classification Search
CPC ..... H01R 13/477; H01R 27/00; H01R 27/02
USPC ..... 439/135–149, 218, 502
See application file for complete search history.

(56) References Cited

U.S. PATENT DOCUMENTS 3,549,861 A * 12/1970 Trachtenberg ..... A47J 41/005 215/12.1
5,050,211 A * 9/1991 Dortu ..... F16P 3/08 379/438
7,121,852 B2 10/2006 Ng
7,179,099 B2 2/2007 Hsieh
7,473,112 B2 * 1/2009 Zhu ..... H05K 5/0278 439/142
7,473,141 B2 1/2009 Liao
7,556,535 B2 7/2009 Liao
7,740,495 B1 * 6/2010 Lo ..... G06K 19/07 439/142
7,778,037 B2 8/2010 Huang
7,841,903 B2 * 11/2010 Saito ..... H01R 13/6675 439/638
8,096,820 B2 * 1/2012 Lyu ..... H01R 27/00 439/141
8,194,408 B2 6/2012 Chou et al.
8,298,003 B2 * 10/2012 Wu ..... H01R 27/02 439/501

(Continued)

*Primary Examiner* — Amy Cohenjohnson
*Assistant Examiner* — Oscar C Jimenez
(74) *Attorney, Agent, or Firm* — Ming Chieh Chang; We Te Chung

(57) ABSTRACT

A cable connector assembly (100, 100') includes a first cable end (1, 1'), a second cable end (2, 2'), and a cable (3, 3') connecting between the first cable end and the second cable end. The first cable end has a first insulative body (11, 11') and a first connecting tongue (12, 12') extending beyond the first insulative body. The second cable end has a second insulative body (211, 211'), a third insulative body (212, 212') extending from the second insulative body, a second connecting tongue (23, 23') extending beyond the second insulative body, and a third connecting tongue (24, 24') extending beyond the third insulative body. The cable connector assembly has a cover (25, 25') covering the second cable end along a first direction. The cover is moveable with respect to the second cable end in a second, perpendicular direction to cover one of the two connecting tongues.

7 Claims, 7 Drawing Sheets

(56) References Cited

U.S. PATENT DOCUMENTS 8,500,467 B2 * 8/2013 Ni ..... G06K 19/07732 439/136

8,550,856 B2 10/2013 Lin

2009/0113101 A1 * 4/2009 Liu ..... H01R 31/06 710/300

2011/0269335 A1 11/2011 Zhang et al.

* cited by examiner

CABLE CONNECTOR ASSEMBLY HAVING SEVERAL PLUG CONNECTORS

BACKGROUND OF THE INVENTION

1. Field of the Invention

The present invention relates generally to a cable connector assembly, and more particularly to a cable connector assembly having several plug connectors but only two of which are simultaneously in use while others are not in use.

2. Description of Related Arts

An adapter or cable connector assembly having several plug connectors is widely used for its multi-functions. The multi-functional cable connector assembly has a cable, a first plug connector at a first end of the cable, and at least two plug connectors (namely a second plug connector, a third plug connector, etc.) at a second end of the cable which is opposite to the first plug connector. The at least two plug connectors usually have different interfaces for adapting to different devices. In use, the first plug connector is connected with a first receptacle connector of a first device and one of the at least two plug connectors is connected with a second receptacle connector of a second device for electrically connecting the first and second devices. The second plug connector and the third plug connector are selectively in use. Therefore, the free ones of the at least two plug connectors are usually exposed to air.

A cable connector assembly preventing certain plug connectors thereof not in use from damaging is desired.

SUMMARY OF THE INVENTION

Accordingly, an object of the present invention is to provide a cable connector assembly with a protective cover on a not-in-use plug connector thereof To achieve the above object, a cable connector assembly includes a first cable end, a second cable end, and a cable connecting between the first cable end and the second cable end. The first cable end has a first insulative body and a first connecting tongue extending beyond the first insulative body. The second cable end has a second insulative body, a third insulative body extending from the second insulative body, a second connecting tongue extending beyond the second insulative body, and a third connecting tongue) extending beyond the third insulative body. The cable connector assembly has a cover covering the second cable end along a first direction. The cover is moveable with respect to the second cable end in a second, perpendicular direction to cover one of the two connecting tongues.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Figure 1:
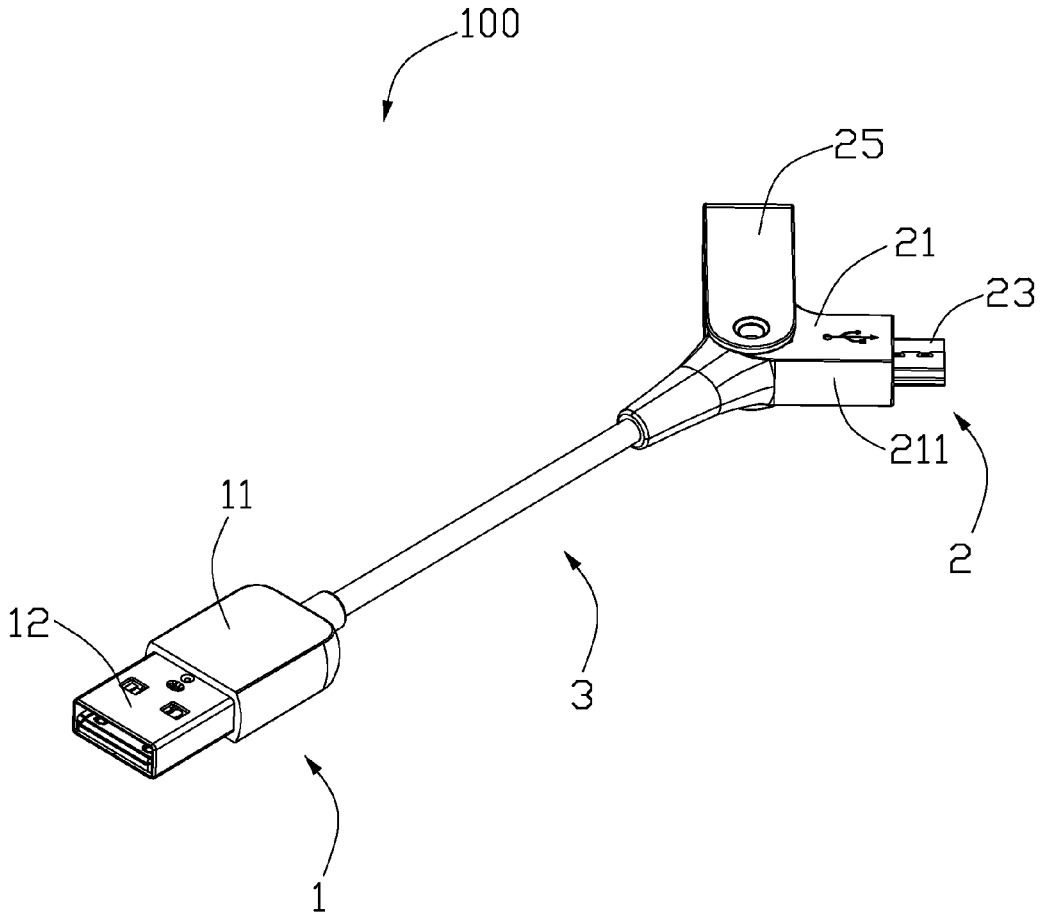
FIG. 1 is a perspective, assembled view of a cable connector assembly in a first embodiment constructed in accordance with the present invention.
Figure 2:
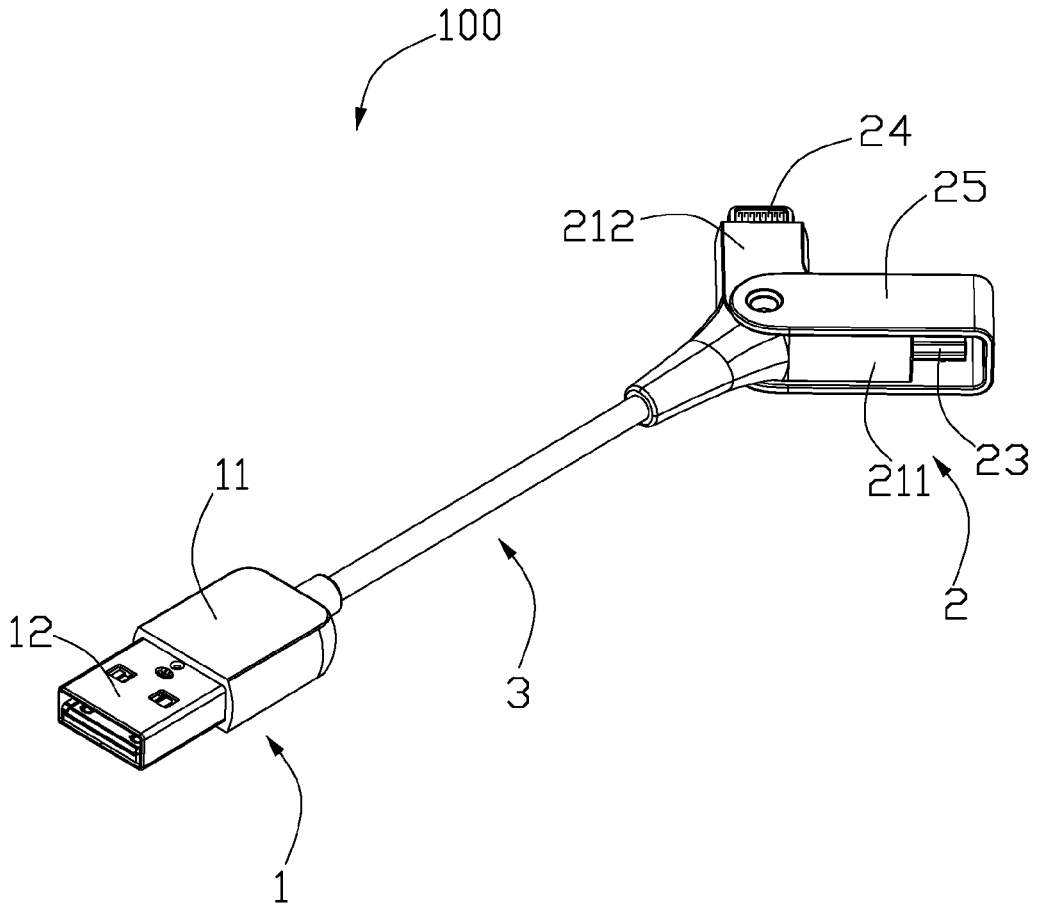
FIG. 2 is similar to FIG. 1, but taken from a different view.
Figure 3:
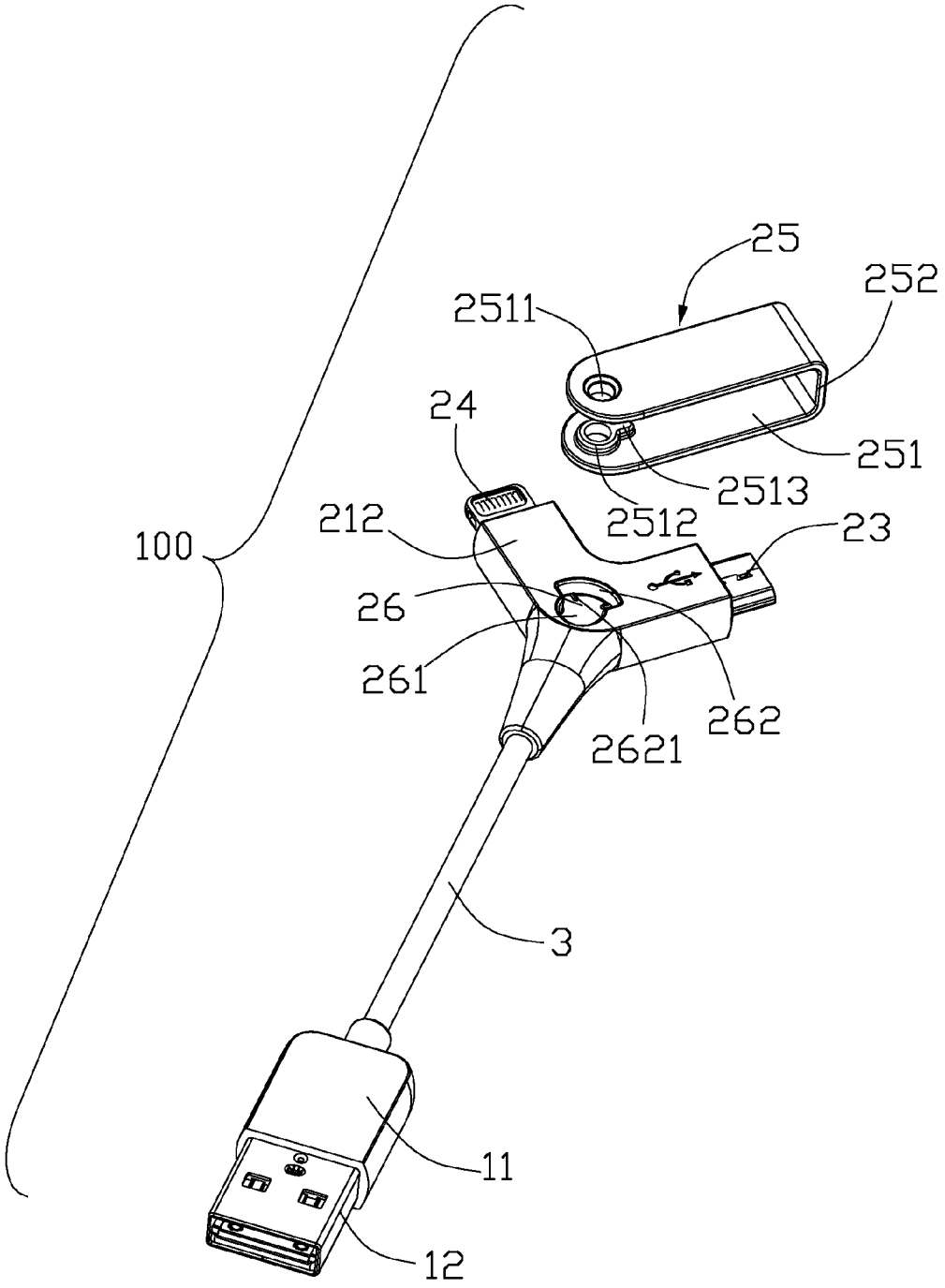
FIG. 3 is a perspective, exploded view of the cable connector assembly of FIG. 1.
Figure 4:
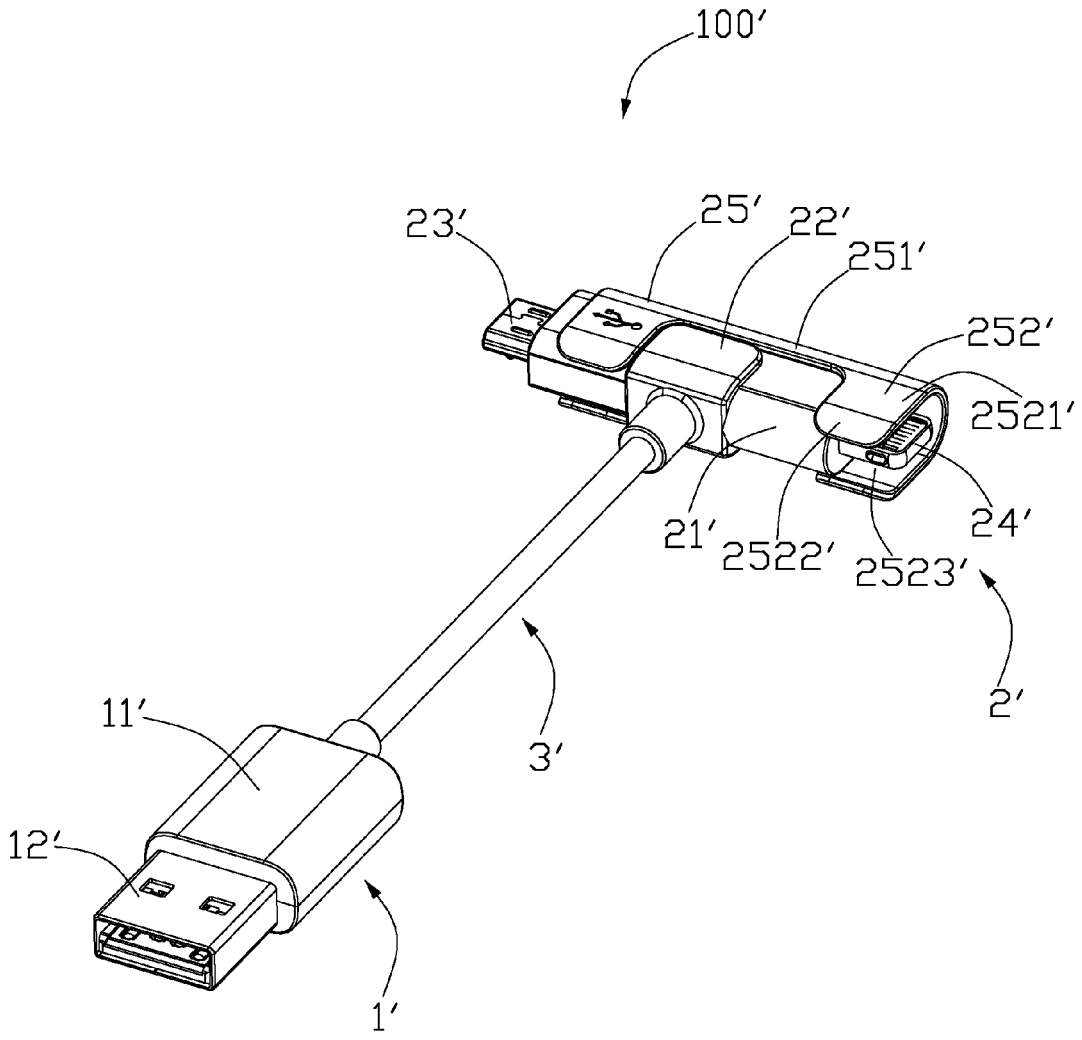
FIG. 4 is a perspective, assembled view of the cable connector assembly in a second embodiment constructed in accordance with the present invention.
Figure 5:
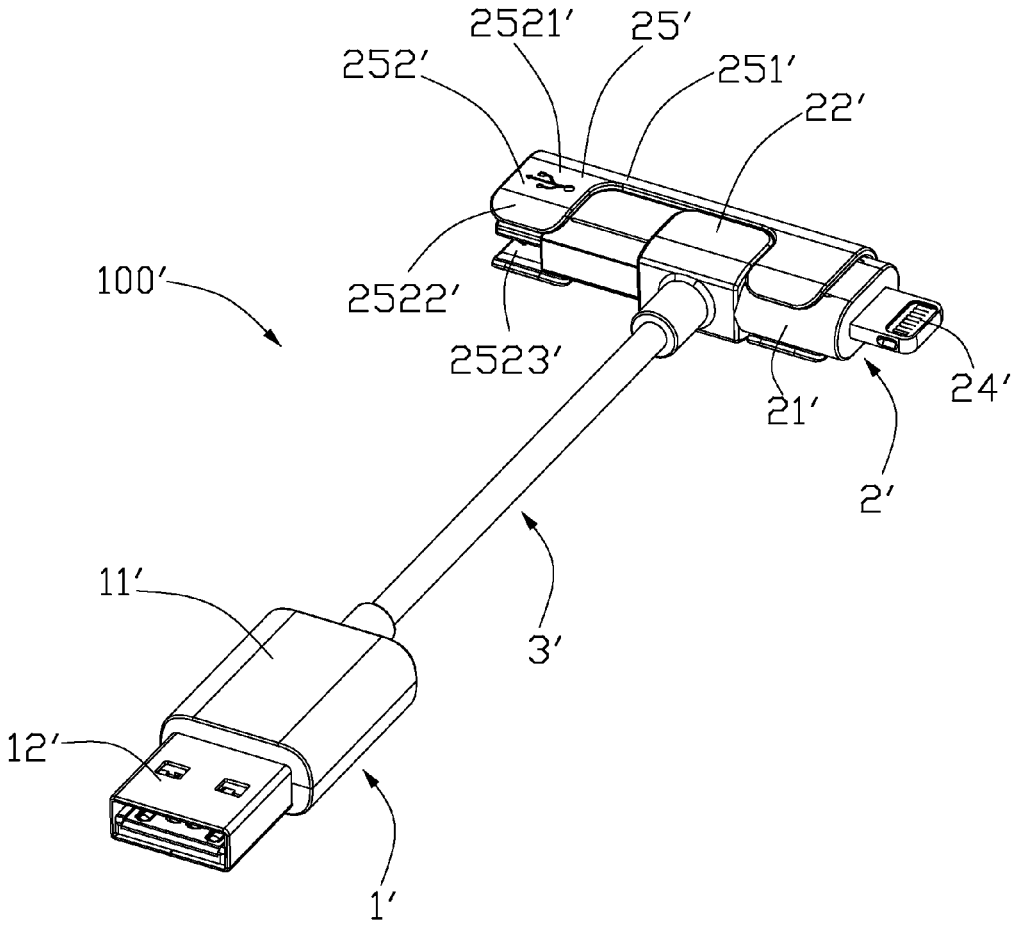
FIG. 5 is similar to FIG. 4, but taken from a different view.

Referring to FIGS. 1-3, a cable connector assembly 100 in a first embodiment of the present invention, comprises a first cable end 1, a second cable end 2, and a cable 3 connected between the first cable end 1 and the second cable end 2.

Referring to FIGS. 1 and 3, the first cable end 1 comprises a first plug connector 1 having a first insulative body 11 and a first connecting tongue 12 extending forwardly from and beyond the first insulative body 11. The first plug connector 1 is a standard USB (Universal Serial Bus) plug connector for being connected to a computer device.

Referring to FIGS. 1 and 3, the second cable end 2 comprises a forked portion 21 having a second insulative body 211 and a third insulative body 212 angularly extending from the second insulative body 211. The forked portion 21 defines a pivoting hole 26 at each upper-and-lower side of a connection part between the second insulative body 211 and the third insulative body 212. The pivoting hole 26 has a round portion 261 and a fan-shaped portion 262 connecting to and beside with the round portion 261. The fan-shaped portion 262 has a pair of protrusions 2621. Each protrusion 2621 spaces a little distance away from the adjacent wall of the fan-shaped portion 262. The second cable end 2 comprises a second connecting tongue 23 extending forwardly and beyond the second insulative body 211 and a third connecting tongue 24 extending forwardly and beyond the third insulative body 212. The second insulative body 211 and the second connecting tongue 23 are combined to be a second plug connector. The third insulative body 212 and the third connecting tongue 24 are combined to be a third plug connector. Therefore, the second plug connector and the third plug connector are positioned angular to each other for adapting different mobile devices.

Referring to FIGS. 1 and 3, the second cable end 2 further comprises a rotatable cover 25 pivoted to the forked portion 21. The rotatable cover 25 is substantially U-shaped, having two wing portions 251 and a bridge portion 252 connecting between the two wing portions 251. Each wing portion 251 has a pivoting portion 2511 having a pivoting bar 2512 protruding inwardly toward the opposing wing portion 251 and a straight bar 2513 extending sidewardly and outwardly from the pivoting bar 2512. The rotatable cover 25 is assembled to the forked portion 21 with the pivoting portion 2511 is received the pivoting hole 26. In detail, the pivoting bar 2512 rotates in the round portion 261. The straight bar 2513 moves along the fan-shaped portion 262 and engages with corresponding protrusions 2621 to restrict rotation degree of the pivoting bar 2512. Therefore, the rotatable cover 25 is pivoted to rotate around the pivoting hole 26 and selectively cover the second connecting tongue 23 and the third connecting tongue 24. When one of the second connecting tongue 23 and the third connecting tongue 24 is in use, the other one of the second connecting tongue 23 and the third connecting tongue 24 is protected by the rotatable cover 25 for being prevented from damage when exposed into air. In another embodiment, the rotatable cover may form a fan-like configuration so as to simultaneously cover the second connecting tongue 23 and the third connecting tongue 24 when the second cable end (2)

is not used, and expose at either one of the second connecting tongue 23 and the third connecting tongue 24 while still covering the other by rotation of the cover. Understandably, the rotation range may be around 180 degrees preferably.

Referring to FIGS. 4-7, a cable connector assembly 100' in a second embodiment of the present invention comprises a first cable end 1', a second cable end 2', and a cable 3' connected between the first cable end 1' and the second cable end 2'.

Referring to FIGS. 4-7, the first cable end 1' comprises a first plug connector 1' having a first insulative body 11' and a first connecting tongue 12' extending forwardly from and beyond the first insulative body 11'. The first plug connector 1' is a standard USB plug connector for being connected to a computer device.

Referring to FIGS. 4-7, the second cable end 2' comprises a linear portion 21' having a second insulative body 211' and a third insulative body 212' straightly and oppositely extending from the second insulative body 211, a secured portion 22' tying the linear portion 21' to the cable 3', a second connecting tongue 23' extending forwardly and beyond the second insulative body 211', a third connecting tongue 24' extending backwardly and beyond the third insulative body 212', and a slidable cover 25' assembled to the linear portion 21'. The second insulative body 211' and the second connecting tongue 23' are combined to be a second plug connector. The third insulative body 212' and the third connecting tongue 24' are combined to be a third plug connector. Therefore, the second plug connector and the third plug connector are angularly positioned for adapting different mobile devices.

Figure 6:
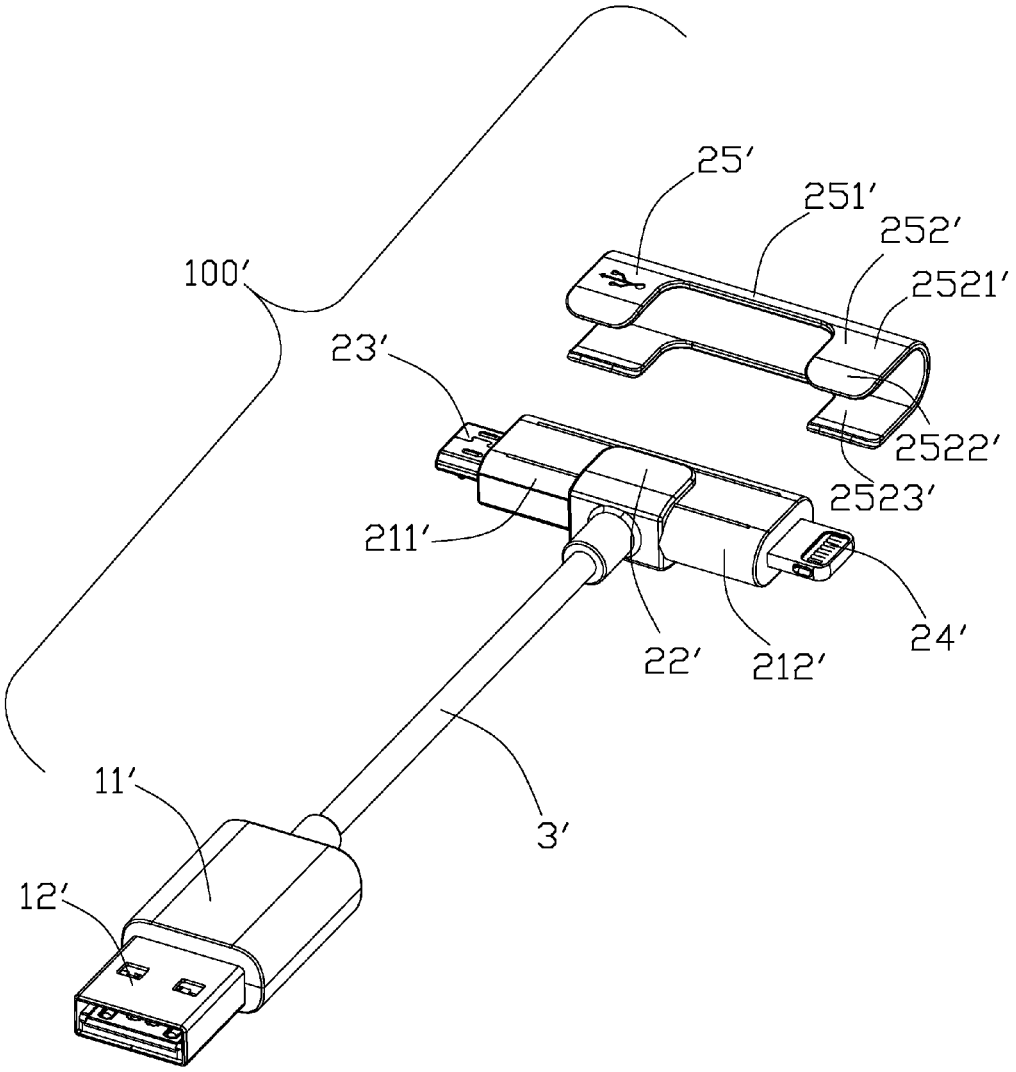
FIG. 6 is a perspective, exploded view of the cable connector assembly of FIG. 4.

Referring to FIG. 6, the slidable cover 25' comprises an arcuate base portion 251' and two pairs of extension portions 252' formed at two free ends of the arcuate base portion 251'. The extension portions 252' extend from margins of the arcuate base portion 251' outwardly for a small distance away from an opening defined by the arcuate base portion 251'. In assembling, the slidable cover 25' is attached outside of the linear portion 21'. The first pair of extension portions 252' at a front end of the arcuate base portion 251' are spaced from the second pair of extension portions 252' at a rear end of the arcuate base portion 251' by the secured portion 22' to restrict sliding degree of the slidable cover 25'. Therefore, the slidable cover 25' moves along the linear portion 21' to selectively cover the second connecting tongue 23' and the third connecting tongue 24'. When one of the second connecting tongue 23' and the third connecting tongue 24' is in use, the other one of the second connecting tongue 23' and the third connecting tongue 24' is protected by the slidable cover 25' for being prevented from damage when exposed to air. Each extension portion 252' at the same end of the slidable cover 25' comprises a flat portion 2521' connecting to the arcuate base portion 251' and a snapping portion 2522' extending from the flat portion 2521' but bends toward the opposing extension portion 252' so that the snapping portions 2522' at the same end of the slidable cover 25' cooperatively define a gradually reduced opening 2523' for firmly clapping the slidable cover 25' onto the linear portion 21' when the slidable cover 25' moves along the linear portion 21'.

Figure 7:
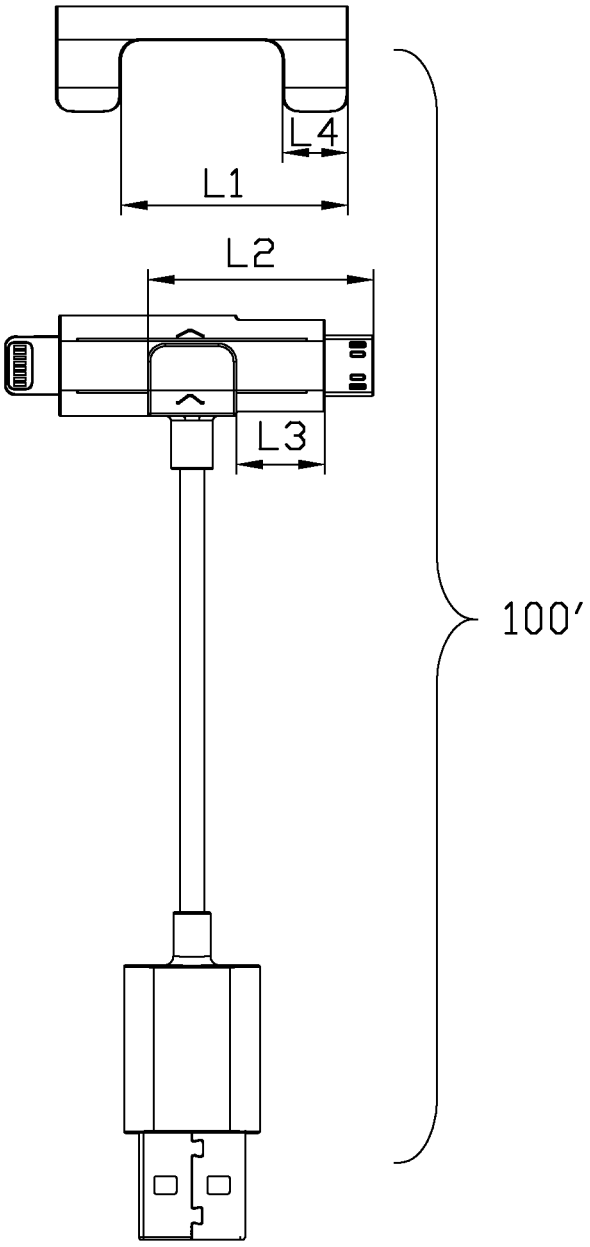
FIG. 7 is a top, elevational view of the cable connector assembly of FIG. 4.

Referring to FIG. 7, a distance between an inner edge of the front extension portion 252' and an outer edge of the rear extension portion 252' is defined as L1. A distance between a left lateral edge of the secured portion 22' and a free end of the third connecting tongue 24' which is far away from the left lateral edge of the secured portion 22' but near to the right lateral edge of the secure portion 22' is defined as L2. L1 is larger than or at least equal to L2 to make sure that when the slidable cover 25' is not further moved along a right direction in FIG. 7, the right extension portion 252' is capable of covering the third connecting tongue 24' and conversely, when the slidable cover 25' is not further moved along a left direction in FIG. 7, the left extension portion 252' is capable of covering the second connecting tongue 23'. A distance between a right lateral edge of the secured portion 22' and a free end of the third connecting tongue 24' which is near to the right lateral edge of the secured portion 22' is defined as L3. A width of each extension portion 252' is defines as L4. Distance L3 is equal to or larger than width L4 to ensure enough distance for the slidable cover 25' to move along the linear portion 21' even though the secured portion 22' restricts movement of the slidable cover 25'. In another embodiment, the length of the slidable cover may be increased to cover both the second connecting tongue and the third connecting tongue when the second cable end is unused and to expose either one of the second connecting tongue and the third connecting tongue while covering the other by sliding the cover. Understandably, the sliding range is larger than that disclosed in the embodiment of FIGS. 4-7.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. A cable connector assembly comprising:

a first cable end having a first insulative body and a first connecting tongue extending beyond the first insulative body;

a second cable end having a second insulative body, a third insulative body extending from the second insulative body, a second connecting tongue extending beyond the second insulative body, and a third connecting tongue extending beyond the third insulative body;

a cable connecting between the first cable end and the second cable end; and a cover comprising a U-shaped portion covering the second cable end along a first direction, the cover moveable with respect to the second cable end in a second direction to selectively cover one of the second connecting tongue and the third connecting tongue, wherein the first direction is perpendicular to the second direction: wherein the third insulative body angularly extends from the second insulative body, the cover is pivoted to a connection part of the second insulative body and the third insulative body, and the cover is rotatable between the second insulative body and the third insulative body; wherein the second cable end defines a pivoting hole at each upper-and-lower side of the connection part between the second insulative body and the third insulative body, the U-shaped portion has two wing portions and a bridge portion connecting between the two wing portions, and each wing portion forms a pivoting portion received in the pivoting hole; and the pivoting hole has a round portion and a fan-shaped portion beside and in communication with the round portion, and the pivoting portion has a pivoting bar rotatable in the round portion and a straight bar movable along the fan-shaped portion to restrict a rotational angle of the pivoting bar.

2. The cable connector assembly as claimed in claim 1, wherein the pivoting bar protrudes inwardly toward the opposing wing portion and the straight bar extending sidewardly and outwardly from the pivoting bar.

3. The cable connector assembly as claimed in claim 2, wherein the fan-shaped portion has a pair of protrusions, each protrusion spaces away from an adjacent wall of the fan-shaped portion, and the straight bar is engaged with one of the protrusions for orientation purpose.

4. A cable connector assembly comprising:

a first cable end having a first insulative body and a first connecting tongue extending beyond the first insulative body;

a second cable end having a second insulative body, a third insulative body extending from the second insulative body, a second connecting tongue extending beyond the second insulative body, and a third connecting tongue extending beyond the third insulative body;

a cable connecting between the first cable end and the second cable end; and a cover comprising a U-shaped portion covering the second cable end along a first direction, the cover moveable with respect to the second cable end in a second direction to selectively cover one of the second connecting tongue and the third connecting tongue; wherein the third insulative body straightly and oppositely extends from the second insulative body and cooperates with the second insulative body to define a linear portion, the second cable end comprises a secured portion tying the linear portion to the cable, and the cover is slidable between the second insulative body and the third insulative body; and the cover comprises an arcuate base portion and two pairs of extension portions at two free ends of the arcuate base portion, a first pair of extension portions at a front end of the arcuate base portion are spaced from a second pair of extension portions at a rear end of the arcuate base portion by the secured portion to restrict sliding degree of the cover, and the U-shaped portion comprises a part of the arcuate base portion and the pair of extension portions.

5. The cable connector assembly as claimed in claim 4, wherein each extension portion at the same end of the cover comprises a flat portion connecting to the arcuate base portion and a snapping portion extending from the flat portion and bending toward the opposing extension portion.

6. The cable connector assembly as claimed in claim 5, wherein the snapping portions at the same end of the cover cooperatively defines a gradually reduced opening.

7. A cable connector assembly comprising: an electrical cable defining two opposite first and second ends, at least one electrical connector being electrically and mechanically connected to the first end; at least a first connector and a second connector being electrically and mechanically connected to the second end and angled with each other at a ninety-degree with a fixed relationship, the first connector including a first connecting tongue extending in a first direction, and the second connector including a second connecting tongue spaced from the first connecting tongue and extending in a second direction angled with the first direction with said specific degree; and a cover being dimensioned and configured to be rotatable relative to the second end within a ninety-degree range about a pivotal axis so as to be adapted to selectively cover either one of the first connecting tongue and the second connecting tongue while exposing the other; wherein the cover defines a U-shaped structure composed of a pair of arms spaced from each other linked by a bight at one end of said U-shaped structure without linkage at the other end of said U-shaped structure; wherein a restriction structure corresponding to said ninety-degree range, is formed and hidden between the cover and a joint of said first connector and said second connector without exposure to an exterior; wherein said restriction structure includes a bar formed on one of said cover and said joint, and a recessed portion formed in the other of said cover and said joint; wherein said bar is formed on the cover and said recessed portion is formed in the joint; wherein said recessed portion is fan-shaped.

* * * * *